US009074388B2

(12) United States Patent
Gerber

(10) Patent No.: US 9,074,388 B2
(45) Date of Patent: Jul. 7, 2015

(54) DOOR HANDLE ARRANGEMENT ON A MOTOR VEHICLE

(71) Applicant: Dr. Ing. h.c. F. Porsche Aktiengesellschaft, Stuttgart (DE)

(72) Inventor: Harald Gerber, Walheim (DE)

(73) Assignee: Dr. Ing. h.c.F. Porsche Aktiengesellschaft (DE)

( * ) Notice: Subject to any disclaimer, the term of this patent is extended or adjusted under 35 U.S.C. 154(b) by 0 days.

(21) Appl. No.: 14/105,593

(22) Filed: Dec. 13, 2013

(65) Prior Publication Data

US 2014/0174139 A1 Jun. 26, 2014

(30) Foreign Application Priority Data

Dec. 20, 2012 (DE) ..... 10 2012 112 715

(51) Int. Cl.
*E05B 1/00* (2006.01)
*E05C 3/00* (2006.01)
*E05B 85/16* (2014.01)

(52) U.S. Cl.
CPC ... *E05B 1/00* (2013.01); *E05C 3/00* (2013.01); *E05B 85/16* (2013.01)

(58) Field of Classification Search
CPC ..... E05B 85/18; E05B 77/265; E05B 85/16; E05B 85/10; E05B 85/14; E05B 17/183; E05B 7/00; E05C 3/162; E05C 1/12
USPC ..... 70/455, 215, 208, 221, 224
See application file for complete search history.

(56) References Cited

U.S. PATENT DOCUMENTS

| | | | | |
|---|---|---|---|---|
| 6,240,755 | B1 * | 6/2001 | Da Silva | 70/423 |
| 6,447,030 | B1 * | 9/2002 | Meinke | 292/347 |
| 6,612,630 | B1 | 9/2003 | Meinke | |
| 7,011,349 | B2 * | 3/2006 | Nomura et al. | 292/347 |
| 7,070,216 | B2 * | 7/2006 | von zur Muehlen | 292/336.3 |
| 7,152,893 | B2 * | 12/2006 | Pudney | 292/336.3 |
| 7,556,296 | B2 * | 7/2009 | Kondo et al. | 292/336.3 |
| 7,600,795 | B2 * | 10/2009 | Cummins et al. | 292/336.3 |
| 8,469,411 | B2 | 6/2013 | Costigan | |
| 8,584,493 | B2 * | 11/2013 | Gorontzi et al. | 70/208 |

FOREIGN PATENT DOCUMENTS

| | | |
|---|---|---|
| DE | 100 00 540 | 8/2001 |
| DE | 101 23 826 | 11/2002 |

(Continued)

OTHER PUBLICATIONS

German Search Report dated Aug 22, 2013.

*Primary Examiner* — Suzanne Barrett
(74) *Attorney, Agent, or Firm* — Gerald E. Hespos; Michael J. Porco; Matthew T. Hespos

(57) ABSTRACT

A door handle arrangement (4) of a motor vehicle has a door handle (5) with a first end (6) pivotably mounted in a door (2) and a second end (7) remote from the first end (6) has an actuation projection (8) that protrudes into the door (2) and actuates a door lock when the door handle (5) is pivoted with its second end (7) away from the door (2). A cover (9) is mounted in the door (2) and adjacent to the second handle end (7). The door handle (5) and the cover (9) have interacting guides (14, 15) for guiding the door handle (5) relative to the cover element (9) when the door handle (5) is pivoted for actuating the door lock.

11 Claims, 2 Drawing Sheets

(56) References Cited

FOREIGN PATENT DOCUMENTS

| | | |
|---|---|---|
| DE | 102 20 787 | 11/2003 |
| DE | 10 2004 059 519 | 6/2006 |
| DE | 10 2009 042 334 | 4/2010 |
| EP | 1 099 816 | 5/2001 |
| WO | 2009/037187 | 3/2009 |

* cited by examiner

DOOR HANDLE ARRANGEMENT ON A MOTOR VEHICLE

CROSS REFERENCE TO RELATED APPLICATION

This application claims priority under 35 USC 119 to German Patent Appl. No. 10 2012 112 715.8 filed on Dec. 20, 2012, the entire disclosure of which is incorporated herein by reference.

BACKGROUND

1. Field of the Invention

The invention relates to a door handle arrangement on an outer side of a door of a motor vehicle. The door handle arrangement has a door handle with opposite first and second ends. The first end is mounted pivotably in the door. An actuation projection is at the second end and protrudes into the door. The actuation projection actuates a door lock when the door handle is pivoted away from the door. A cover element is mounted in the region of the outer side of the door and adjacent to the second end of the handle.

2. Description of the Related Art

The expression "door" is used herein in a broad sense and relates not only to a door per se, but also to a flap or the like on a motor vehicle and formed with a door lock for closure of the door or flap.

DE 101 23 826 A1 discloses a door handle arrangement of the type mentioned above. The door handle is assigned to a door recess in the door and has opposite first and second ends. The door handle is pivotable in the region of the first handle end about a static axle of the door. The second end of the handle is arranged with a small lateral spacing to a cover element that is connected to the door. An actuation projection for actuating the door lock passes through a hole that is arranged at a location in the door adjacent to the cover element.

The door handle is gripped at a distance from the static pivot axle, and different pivoting and bending forces are introduced into the door handle depending on the specific grip situation. The static pivot axle provides inadequate tilt resistance of the door handle, particularly when the door handle is pulled to unlock the door.

The cover element covers a lock cylinder of the door lock and is provided with a hole, and a door cylinder extends through the hole for receiving a key.

Man doors and flaps cannot be locked and thus do not have a lock cylinder. For example, passenger doors and rear doors of motor vehicles do not have a hole that interacts with a lock cylinder. A cover element nevertheless is used as a part complementary to the door handle from an aesthetic aspect so that the door handle arrangement has an advantageous overall appearance.

DE 100 00 540 C1 describes a door handle arrangement on a motor vehicle where a recess-like cover element interacts with a door handle. The cover element is formed by a handle recess of the door handle and has a hole for receiving a lock cylinder of a door lock.

It is an object of the invention to develop a door handle arrangement of the type described above with a tilt-resistant mounting of the door handle during the pivoting movement thereof, in particular during the movement of the door handle into its open position.

SUMMARY OF THE INVENTION

The invention relates to a door handle arrangement where the door handle and the cover element have interacting guides for guiding the door handle relative to the cover element when the door handle is pivoted for actuating the door lock. This design ensures that the second end of the handle is guided in the cover element when pivoting of the door handle. Accordingly, the door handle is mounted in the region of both ends of the handle. The first end of the door handle is mounted pivotably, and the second end of the door handle is mounted in a guided manner. This results in a particularly expedient tilt resistance of the door handle during the pivoting movement thereof. This applies in particular when the door handle is gripped by hand to open the door, and different forces and different torques are introduced into the door handle depending on the person opening the door.

The guides preferably are arranged to guide that the door handle during movement from the pivoted-in position to the pivoted-out position and vice versa. Thus, the guides guide the door handle over the entire pivoting path, both when the door handle is pulled and when the door handle is released, in particular during the return pivoting movement of the door handle under the action of spring force.

The region of the first end of the door handle may be mounted on an axle so as to be free from play with respect to the axle. Thus, when the door handle is gripped, the door handle is pivoted in the region of the first end of the handle about the axle. However, the door handle may be mounted in the region of its first axle with a certain amount of play with respect to an axle, and thus the door handle may be mounted on the axle with play. In both cases, the additional guidance of the door handle in the region of the second end contributes to an optimization of the tilt resistance of the door handle, particularly in the region of the second end of the handle, which is remote from the first end of the handle. The door handle itself may thus be of less stable design, because it is provided with additional guidance in the region of the second end of the handle.

The door handle arrangement may be used on a door that accommodates a lock cylinder for the door lock to secure the door against unauthorized opening. The cover element advantageously covers the lock cylinder. The cover element may have a through hole for receiving a key for the lock cylinder.

The door lock also may be actuated by a keyless go system that does not require a key. The cover element thus may perform merely a covering function. The covering function consists primarily in covering the door laterally in the region of a hole that is passed through by the actuation projection for the actuation of the door lock. Aside from this, the cover element performs a design function, because it forms a harmonious elongation of the door handle.

The cover element may be a cover cap. Thus, the cover element may be of cap-like design and may be highly suitable for covering the region of the door that is adjacent to the actuation projection. In particular, the cover element performs a protective cap function, and thus ensures that no unauthorized manipulation is possible from the outside in the region of the door lock.

The guide of the door handle may form a structural unit with the actuation projection. For example, said guide may be formed integrally directly on the actuation projection, or the guide element that has said guide forms a combined component with the actuation projection.

The actuation projection may pass through an opening in the door and may extend into the door interior. The actuation projection may be have one of the guides that interacts with another guide. The other guide may be provided on the cover element. Thus, the guides interact both when the door handle is in the pivoted-in position, when the door handle is in the pivoted-out position and in intermediate positions. The door handle thus is guided with respect to the cover element and with respect to the door in all positions.

The guide of the projection may be a guide track.

The interacting guides may be of different designs to ensure the tilt resistance of the door handle. One preferred design provides that one guide has a positive guide profile and the other guide has a negative guide profile. One guide is thus of elevated form, whereas the other is of complementarily recessed form. For example, the guide assigned to the cover element may have a positive substantially triangular cross section, and the guide assigned to the door handle may have a negative substantially triangular cross section. The cross sections are adapted so that the interacting guides guide the door handle and the cover element with relatively little play when the door handle is pivoted.

The door handle may be pivotable about a vertical axle, and thus about an axle in the Z direction. The door handle arrangement of the invention ensures that the tilting play in the Z direction that is common in known door handle arrangements is reduced considerably.

Further features of the invention will emerge from the appended drawing and from the description of the preferred embodiment illustrated in the drawing, without the features being restricted to the exemplary embodiment.

DETAILED DESCRIPTION OF THE PREFERRED EMBODIMENTS

Figure 1:
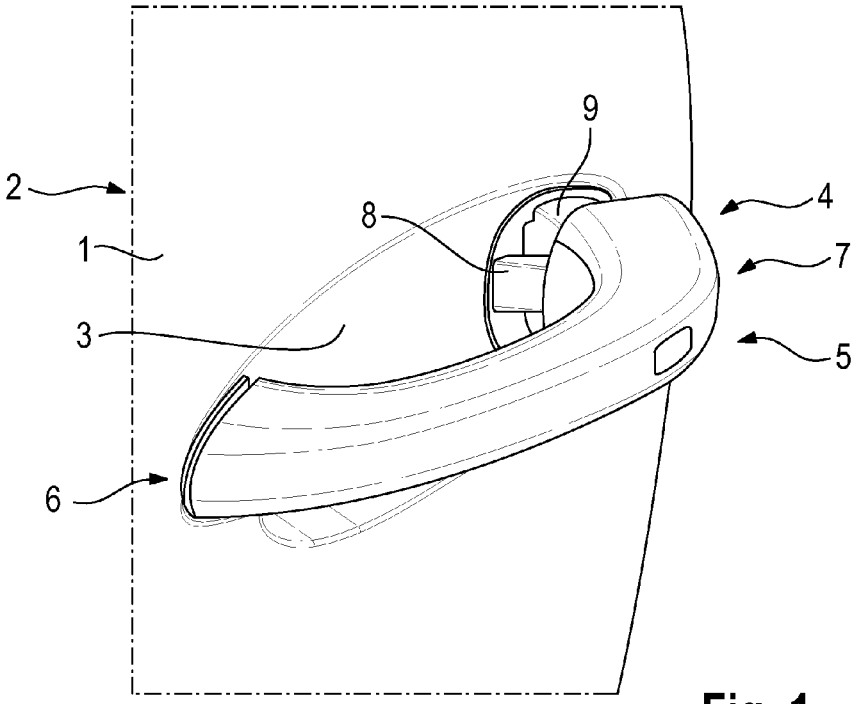
FIG. 1 is a three-dimensional view of the door handle arrangement of the invention on a motor vehicle equipped with a keyless go system, illustrated in the pivoted-out position of the door handle.
Figure 2:
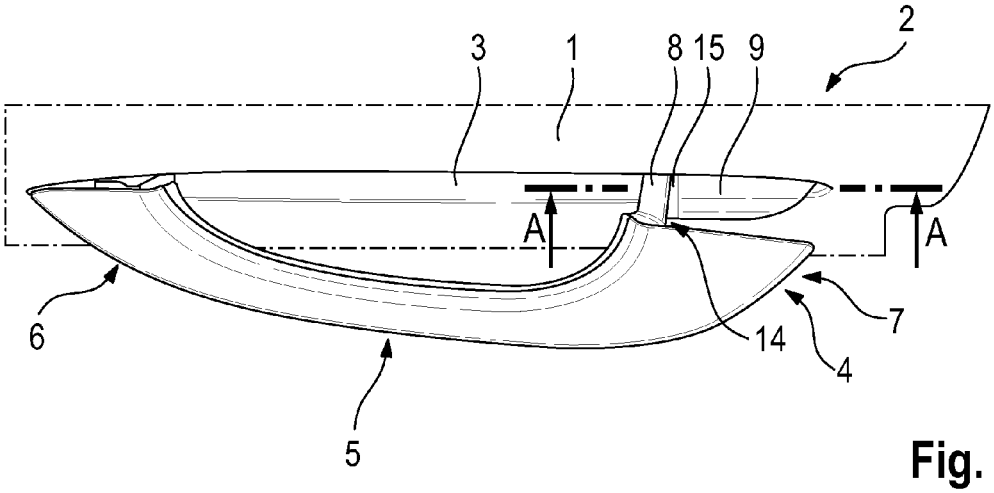
FIG. 2 is a plan view of the door handle arrangement of FIG. 1.

FIGS. 1 and 2 show a door outer side or outer skin 1, in the form of a sheet-metal part, of a vehicle door 2 of a motor vehicle. The door 2 is a driver's door. The outer skin 1 is provided with a handle recess 3. A door handle arrangement 4 is mounted in the vehicle door 2 in the region of the front and rear ends of the handle recess 3. The door handle arrangement 4 has a door handle 5 on the outer side of the outer skin 1. The door handle 5 has a first end 6 pivotably mounted in the door 2 and a second end 7 remote from the first end 6. The second end 7 has an actuation projection 8 that protrudes into the door 2. The actuation projection functions to actuate a door lock when the door handle 5 is pivoted with its second handle end 7 away from the driver's door 2 or from the outer skin 1.

FIGS. 1 and 2 show the door handle 5 in its pivoted-out position, in which the door lock has been moved into its open position.

The door handle arrangement 4 also has a cover 9. The cover 9 is mounted in the door 2 in the region of the outer skin 1 thereof, and thus in the region of the door outer side adjacent to the second end 7.

The door handle 5 has integrated therein electronics components relating to the keyless go system. Electrical connecting lines for the electronics components run from the door handle 5, via its pivot region assigned to the first handle end 6, into the door 2. The cover 9 is of cap-like design and performs the function of a protective cap by covering a lock cylinder that interacts with the door lock. In this regard, the cover 9 has a through hole 10 for receiving the lock cylinder in that region of the lock cylinder remote from the door 2. A key for locking the lock cylinder is inserted into the latter in said region.

The cover 9 is held in a defined position, in the region of the rear end of the handle recess 3 in relation to the direction of travel of the motor vehicle, by way of retention means arranged on that side of the outer skin 1 which is remote from the door handle 5. The retention means are inserted into grooves 11 of the cover 9.

When the door handle 5 is pivoted out of the position in which its second end 7 bears against the outer skin 1 into the pivoted-out position shown in FIGS. 1 and 2, the actuation projection 8 of the door handle 5 is moved farther out so that a web projection 12 of the actuation projection 8 passes through an opening that is matched to the actuation projection in terms of cross section, in the handle recess 3, and an actuation pin 13 that is connected to the free end of the web projection 12 and acts on the door lock is arranged within the hollow vehicle door 2.

Interacting guides 14 and 15 are provided on the web projection 12 of the actuation projection 8 and on the cover 9 for tilt-resistant mounting of the actuation projection 8. The guides 14, 15 guide the door handle 5 relative to the cover 9 when the door handle 5 is pivoted for the purpose of actuating the door lock.

With regard to tilting play of the door handle 5 in the coordinate direction Z, that is to say tilting of the door handle 5 upward and downward, a certain degree of tilt resistance can be eliminated already by virtue of the fact that the door handle 5 is pivoted about an axle in the region of its first handle end 6. If such precise pivoting of said first handle end of the door handle 5 about a defined axle is not desired and, instead, provision is made for a certain tilting movement of the door handle 5 to be permitted in the region of the first handle end 6, the guides 14 and 15 nevertheless ensure precise guidance of the door handle 5 in the region of its second handle end 7 owing to the interaction of the door handle 5 with the cover 9. Said guides 14 and 15 thus guide the door handle 5 relative to the cover 9 when the door handle 5 is pivoted for the purpose of actuating the door lock.

Figure 3:
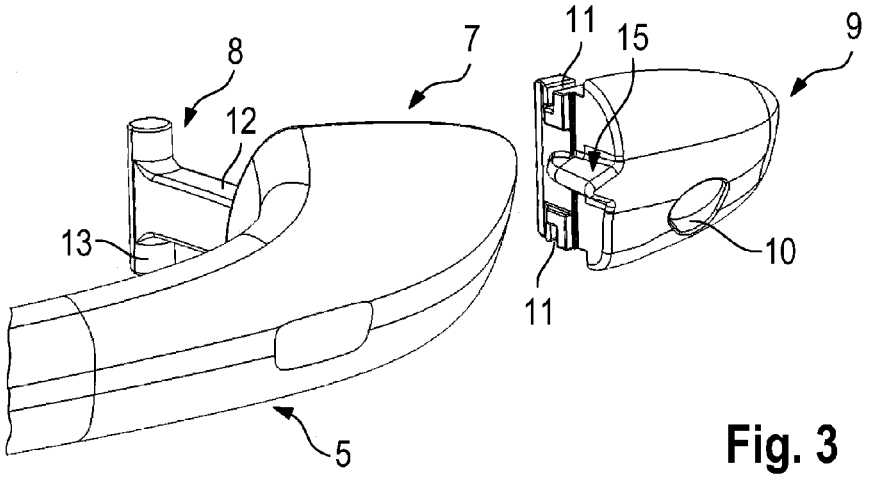
FIG. 3 is a front exploded perspective view of a cover element and an end of a door handle that interacts with the cover element of the door handle arrangement of FIG. 1.
Figure 4:
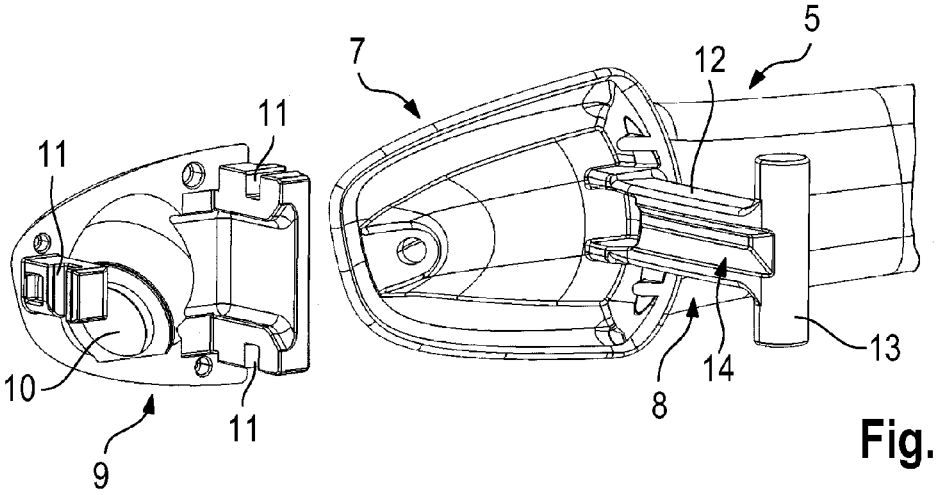
FIG. 4 is an exploded rear perspective view of the arrangement shown in FIG. 3.

The specific design of the guides 15 and 14 is illustrated in FIG. 3, for the cover element 9, and in FIG. 4, for the end of the door handle 5 shown therein.

Figure 5:
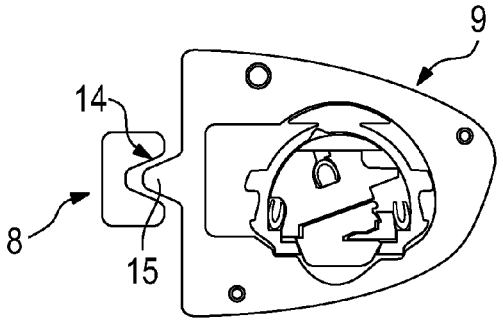
FIG. 5 is a section along the line A-A in FIG. 2.

The web projection 12 of the actuation projection 8 of the door handle 5 is accordingly provided with the guide 14, which has a negative guide profile, specifically a V-shaped groove, as can be seen in particular from the sectional illustration in FIG. 5. Said guide 14 extends over the entire length of the web projection 12. The guide 15 of the cover 9 has a complementary positive guide profile, as can be seen in particular from the illustration in FIG. 5. The cross section of said guide 15 has the shape of a substantially equilateral triangle with a rounded tip pointing toward the guide 14. The guide 15 extends over the entire height of that region of the cover element 9 which protrudes outward beyond the outer skin 1 of the vehicle door 2.

The door handle 5 is arranged substantially horizontally and is pivotable about a substantially vertical axis—the Z axis. The guides 14 and 15, which act in an X-Y plane, provide precise guidance of the door handle 5 in the cover element 9 and thereby prevent tilting movement of the door handle 5 relative to the cover element 9 or relative to the vehicle door 2.

What is claimed is:

1. A door handle arrangement on a door outer side of a motor vehicle, comprising a door handle with a first end mounted pivotably in a door and a second end remote from the first end, the second end having an actuation projection that protrudes through an opening in the door and into the door for, an actuation pin projecting at the free end of the actuation projection for actuating a door lock when the door handle is pivoted to move the second end away from the door, and a cover mounted in the door in a region of the door outer side and adjacent to the second handle end, the actuating projection having a first guides that includes a web projection with a guide track defining a negative profile in the web projection, the negative profile extending substantially parallel to a moving direction of the second end of the door handle when the door handle is pivoted and extending an entire projecting distance of the actuating projection, the cover having a second guide with a positive profile projecting from the cover and slidably engaged in the negative profile of the first guide for guiding the door handle relative to the cover when the door handle is pivoted to actuate the door lock.

2. The door handle arrangement of claim 1, wherein the guides are arranged to guide the door handle during a movement from a pivoted-in position to a pivoted-out position and vice versa.

3. The door handle arrangement of claim 2, wherein first end of the door handle is pivotable about an axle.

4. The door handle arrangement of claim 1, wherein the door has a lock cylinder, and the cover forms a structural unit with the lock cylinder.

5. The door handle arrangement of claim 1, wherein the door has a lock cylinder, and the cover is a component separate from the lock cylinder.

6. The door handle arrangement of claim 4, wherein the cover element has a through hole for receiving a key for the lock cylinder.

7. The door handle arrangement of claim 1, wherein the cover element is in the form of a cover cap.

8. The door handle arrangement of claim 1, wherein the door handle is pivotable about a vertical axle.

9. The door handle arrangement of claim 1, wherein the second guide extends over an entire projecting extent of the cover extending out from an outer surface of the door.

10. The door handle arrangement of claim 1, wherein the negative profile of the first guide defines a V-shaped groove formed in the web projection.

11. The door handle arrangement of claim 10, wherein the second guide has a cross section corresponding to the V-shaped groove in the first guide.

* * * * *